US008879938B2

(12) United States Patent
Gyotoku

(10) Patent No.: US 8,879,938 B2
(45) Date of Patent: Nov. 4, 2014

(54) DEVELOPING DEVICE AND IMAGE FORMING APPARATUS INCLUDING SAME

(71) Applicant: Kyocera Document Solutions Inc., Osaka (JP)

(72) Inventor: Eiji Gyotoku, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 14/027,363

(22) Filed: Sep. 16, 2013

(65) Prior Publication Data

US 2014/0086607 A1 Mar. 27, 2014

(30) Foreign Application Priority Data

Sep. 21, 2012 (JP) ..... 2012-207935

(51) Int. Cl.
*G03G 15/06* (2006.01)

(52) U.S. Cl.
CPC ..... *G03G 15/065* (2013.01)
USPC ..... 399/55; 399/53

(58) Field of Classification Search
None
See application file for complete search history.

(56) References Cited

U.S. PATENT DOCUMENTS 7,941,080 B2 * 5/2011 Sakata et al. ..... 399/270

FOREIGN PATENT DOCUMENTS

JP 2003-043759 A 2/2003

* cited by examiner

*Primary Examiner* — Clayton E Laballe
*Assistant Examiner* — Jas Sanghera
(74) *Attorney, Agent, or Firm* — Morgan, Lewis & Bockius LLP

(57) ABSTRACT

A developing device of the present disclosure has a developer bearing member, a toner bearing member, a bias controller. With respect to a duty ratio of the alternating current bias of a polarity with which the toner is moved from the developer bearing member to the toner bearing member, a second duty ratio that is a duty ratio of the collection bias is set to be smaller than a first duty ratio that is a duty ratio of the development bias. When a transition is made from the development operation to the collection operation, in a state where the developer bearing member and the toner bearing member are being driven to rotate, the bias controller performs control so that the bias applier applies the alternating current bias having a third duty ratio that is smaller than the first duty ratio and larger than the second duty ratio.

6 Claims, 9 Drawing Sheets

DEVELOPING DEVICE AND IMAGE FORMING APPARATUS INCLUDING SAME

INCORPORATION BY REFERENCE

This application is based on and claims the benefit of priority from Japanese Patent Application No. 2012-207935 filed on Sep. 21, 2012, the contents of which are hereby incorporated by reference.

BACKGROUND

The present disclosure relates to a developing device used in an image forming apparatus such as a printer, and relates particularly to a developing device adopting a two-component developer containing a carrier and toner, and an image forming apparatus including the same.

An image forming apparatus utilizing an electrophotographic method, such as a copy machine, a printer, or a facsimile, is configured so that an electrostatic latent image formed on an image bearing member (for example, a photosensitive drum or a transfer belt) is supplied with a developer and developed therewith to form a toner image on the image bearing member. As one of methods for performing the development, there is known a touch-down development method using a two-component developer containing toner that is a non-magnetic substance and a carrier that is a magnetic substance. In this case, a two-component developer layer (so-called magnetic brush layer) is borne on a magnetic roller, and toner is moved from the two-component developer layer onto a developing roller, and thus a toner layer is borne thereon. Moreover, toner is supplied from said toner layer to the image bearing member and used to visualize the electrostatic latent image.

In recent years, developing devices adopting the touch-down development method have advanced in terms of their operation speeds, and this has led to a demand for an improvement in their development performance. For example, there has been disclosed a technique for adjusting development performance by varying a duty ratio of an alternating current component of a development bias used at the time of a development operation. By this technique, part of toner on a developing roller, which has a poor flying characteristic, is favorably moved to an image bearing member.

The conventional technique, however, has presented a problem that, due to an increase in operation speed of such a developing device, toner is scattered when being delivered between a magnetic roller and a developing roller. Toner thus scattered is troublesome in that it gathers in a housing of the developing device and then adheres to a photosensitive drum or is spewed out through a gap in the housing into an image forming apparatus.

The present disclosure has been made to solve the above-described problem and has as its object to provide a developing device that prevents toner from being scattered when being delivered between a developing roller and a magnetic roller, and an image forming apparatus including the same.

SUMMARY

A developing device according to one aspect of the present disclosure has a developing housing, a developer bearing member, a toner bearing member, a bias applier, a bias controller, and a rotation driver. The developing housing stores a developer containing toner and a carrier. The developer bearing member, while rotating in a prescribed direction, receives a developer in the developing housing so as to bear a developer layer. The toner bearing member, while rotating in contact with the developer layer, receives toner from the developer layer so as to bear a toner layer, and supplies said toner to an image bearing member that bears a toner image into which an electrostatic latent image formed on a surface of the image bearing member is manifested with the toner. The bias applier applies a bias obtained by superimposing a direct current bias on an alternating current bias to at least one of the developer bearing member and the toner bearing member so as to form a prescribed potential difference between the developer bearing member and the toner bearing member. The bias controller performs control so that at the time of a development operation in which toner is supplied from the developer bearing member to the toner bearing member, the bias applier applies a development bias, and so that at the time of a collection operation in which toner borne by the toner bearing member is forcibly moved back to the developer bearing member, the bias applier applies a collection bias. The rotation driver drives to rotate the developer bearing member and the toner bearing member at the time of the development operation and at the time of the collection operation. With respect to a duty ratio of the alternating current bias of a polarity with which the toner is moved from the developer bearing member to the toner bearing member, a second duty ratio that is a duty ratio of the collection bias is set to be smaller than a first duty ratio that is a duty ratio of the development bias. When a transition is made from the development operation to the collection operation, in a state where the developer bearing member and the toner bearing member are being driven to rotate, the bias controller performs control so that the bias applier applies the alternating current bias having a third duty ratio that is smaller than the first duty ratio and larger than the second duty ratio.

Still other objects of the present disclosure and specific advantages provided by the present disclosure will be made further apparent from the following descriptions of embodiments.

DETAILED DESCRIPTION

Figure 1:
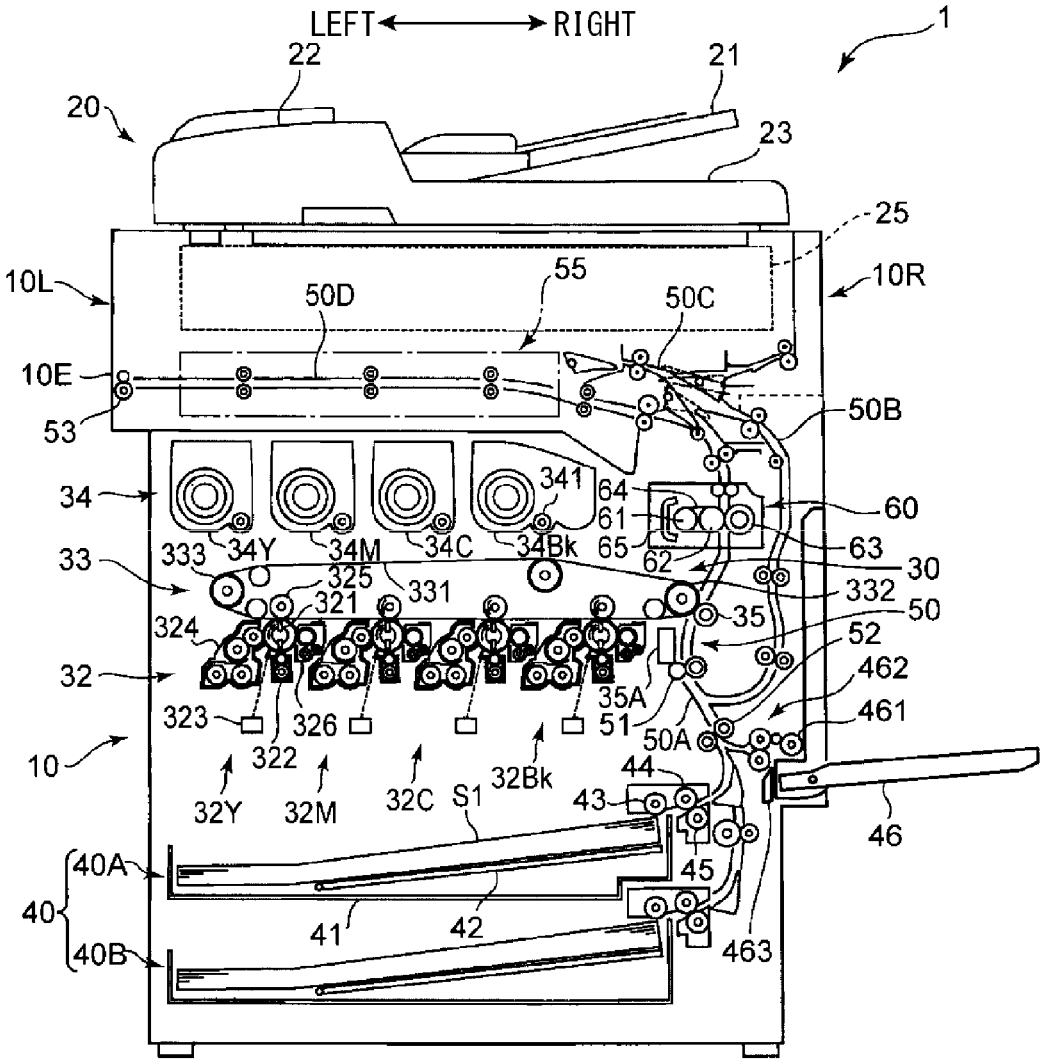
FIG. 1 is a sectional view showing an internal structure of an image forming apparatus according to an embodiment of the present disclosure.

Hereinafter, an embodiment of the present disclosure will be described in detail with reference to the appended drawings. FIG. 1 is sectional view showing an internal structure of an image forming apparatus 1 according to one embodiment of the present disclosure. While the following exemplarily describes, as the image forming apparatus 1, a multifunctional peripheral having a printer function and a copying function, the image forming apparatus may be a printer, a copy machine, or a facsimile machine.

<Explanation of Image Forming Apparatus>

The image forming apparatus 1 includes an apparatus main body 10 and an automatic original document feed device 20. The apparatus main body 10 has a housing structure of a substantially rectangular parallelepiped shape. The automatic original document feed device 20 is disposed over the apparatus main body 10. Inside the apparatus main body 10, a reading unit 25, an image forming portion 30, a fixing portion 60, a paper feed portion 40, a conveying path 50, and a conveying unit 55 are housed. The reading unit 25 optically reads an original document image to be copied. The image forming portion 30 forms a toner image on a sheet. The fixing portion 60 fixes a toner image to a sheet. The paper feed portion 40 stores sheets to be conveyed to the image forming portion 30. The conveying path 50 conveys a sheet from the paper feed portion 40 or a paper feed tray 46 to a sheet ejection outlet 10E via the image forming portion 30 and the fixing portion 60. The conveying unit 55 has inside it a sheet conveying path that constitutes part of the conveying path 50.

The automatic original document feed device (ADF) 20 is pivotally mounted to an upper surface of the apparatus main body 10. The ADF 20 automatically feeds an original document sheet as a copy source toward a prescribed original document reading position in the apparatus main body 10. On the other hand, in a case where a user manually places an original document sheet at the prescribed original document reading position, the ADF 20 is opened upward. The ADF 20 includes an original document tray 21 on which an original document sheet is placed, an original document conveying portion 22 that conveys an original document sheet via an automatic original document reading position, and an original document ejection tray 23 onto which an original document sheet after being read is ejected.

The reading unit 25 optically reads an image of an original document sheet that is automatically fed from the ADF 20 on the upper surface of the apparatus main body 10 or an original document sheet that is manually placed. In the reading unit 25, a scanning mechanism including a light source, a movable carriage, a reflection mirror, and so on and an image sensor are housed (not shown). The scanning mechanism irradiates an original document sheet with light and guides reflected light therefrom to the image sensor. The image sensor photoelectrically converts the reflected light into an analog electric signal. By an A/D conversion circuit, the analog electric signal is converted into a digital electric signal, which then is inputted to the image forming portion 30.

The image forming portion 30 performs processing in which a full-color toner image is generated and transferred onto a sheet, and includes an image forming unit 32 including four units 32Y, 32M, 32C, and 32Bk that are arranged in tandem and form toner images of colors of yellow (Y), magenta (M), cyan (C), and black (Bk), respectively, an intermediate transfer unit 33 disposed above and adjacently to said image forming unit 32, and a toner replenishment portion 34 disposed above the intermediate transfer unit 33.

Each of the image forming units 32Y, 32M, 32C, and 32Bk includes, in addition to a photosensitive drum 321 (image bearing member), a charger 322, an exposer 323, a developing device 324, a primary transfer roller 325, and a cleaning device 326, which are arranged around the photosensitive drum 321.

The photosensitive drum 321 is configured to rotate about an axis thereof, and an electrostatic latent image and a toner image are formed on a peripheral surface thereof. As the photosensitive drum 321, a photosensitive drum using an amorphous silicon (a-Si) material can be used. The charger 322 uniformly charges the surface of the photosensitive drum 321. The exposer 323 has a laser light source and optical devices such as a mirror and a lens, and irradiates the peripheral surface of the photosensitive drum 321 with light based on image data of an original document image, thereby to form an electrostatic latent image thereon.

For the purpose of developing an electrostatic latent image formed on the photosensitive drum 321, the developing device 324 supplies toner to the peripheral surface of the photosensitive drum 321. The developing device 324 is intended for use with a two-component developer and includes a screw feeder, a magnetic roller, and a developing roller. The developing device 324 will be described later in more detail.

The primary transfer roller 325, together with the photosensitive drum 321, forms a nip portion, with an intermediate transfer belt 331 provided in the intermediate transfer unit 33 interposed between itself and the photosensitive drum 321, and primarily transfers a toner image on the photosensitive drum 321 onto the intermediate transfer belt 331. The cleaning device 326 has a cleaning roller and so on and cleans up the peripheral surface of the photosensitive drum 321 after the toner image transfer therefrom.

The intermediate transfer unit 33 includes the intermediate transfer belt 331, a drive roller 332, and a driven roller 333. The intermediate transfer belt 331 is an endless belt laid across the drive roller 332 and the driven roller 333. Furthermore, on an outer peripheral surface of said intermediate transfer belt 331, from a plurality of the photosensitive drums 321, toner images are transferred at a common position in a superimposed manner. The intermediate transfer unit 33 is rotated counterclockwise in FIG. 1.

A secondary transfer roller 35 is disposed to be opposed to a peripheral surface of the drive roller 332. A nip portion formed between the drive roller 332 and the secondary transfer roller 35 functions as a secondary transfer portion where a full-color toner image resulting from superimposition of toner images applied to the intermediate transfer belt 331 is transferred to a sheet. A secondary transfer bias potential opposite in polarity to the toner image is applied to one of the drive roller 332 and the secondary transfer roller 35, and the other of these rollers is grounded. Furthermore, at a position on an upstream side relative to the drive roller 332 in a rotation direction of the intermediate transfer belt 331, a concentration sensor 35A is disposed to be positionally opposed to the peripheral surface of the intermediate transfer belt 331. The concentration sensor 35A outputs an electric signal corresponding to a concentration of the image formed on the intermediate transfer belt 331.

The toner replenishment portion 34 includes a yellow toner container 34Y, a magenta toner container 34M, a cyan toner container 34C, and a black toner container 34Bk. The toner containers 34Y, 34C, 34M, and 34Bk are used to store toner of respective colors and supply the toner of the respective colors, respectively, to the developing devices 324 of the image forming units 32Y, 32M, 32C, and 32Bk corresponding to the colors of Y, M, C, and Bk via unshown supply paths.

The paper feed portion 40 includes paper feed cassettes 40A and 40B for housing sheets to be subjected to image forming processing, which are arranged in two tiers. The paper feed cassettes 40A and 40B can be pulled out frontward from the front of the apparatus main body 10.

The fixing portion 60 is a fixing device employing an induction heating method, which performs fixing processing in which a toner image is fixed to a sheet, and includes a heating roller 61, a fixing roller 62, a pressing roller 63, a fixing belt 64, and an induction heating unit 65. The pressing roller 63 is brought into press-contact with the fixing roller 62, and thus a fixing nip portion is formed therebetween. The heating roller 61 and the fixing belt 64 are induction-heated by the induction heating unit 65 and provide their heat to the fixing nip portion. A sheet is passed through the fixing nip portion, and thus a toner image that has been transferred to the sheet is fixed to said sheet.

<Configuration of Developing Device>

Figure 2:
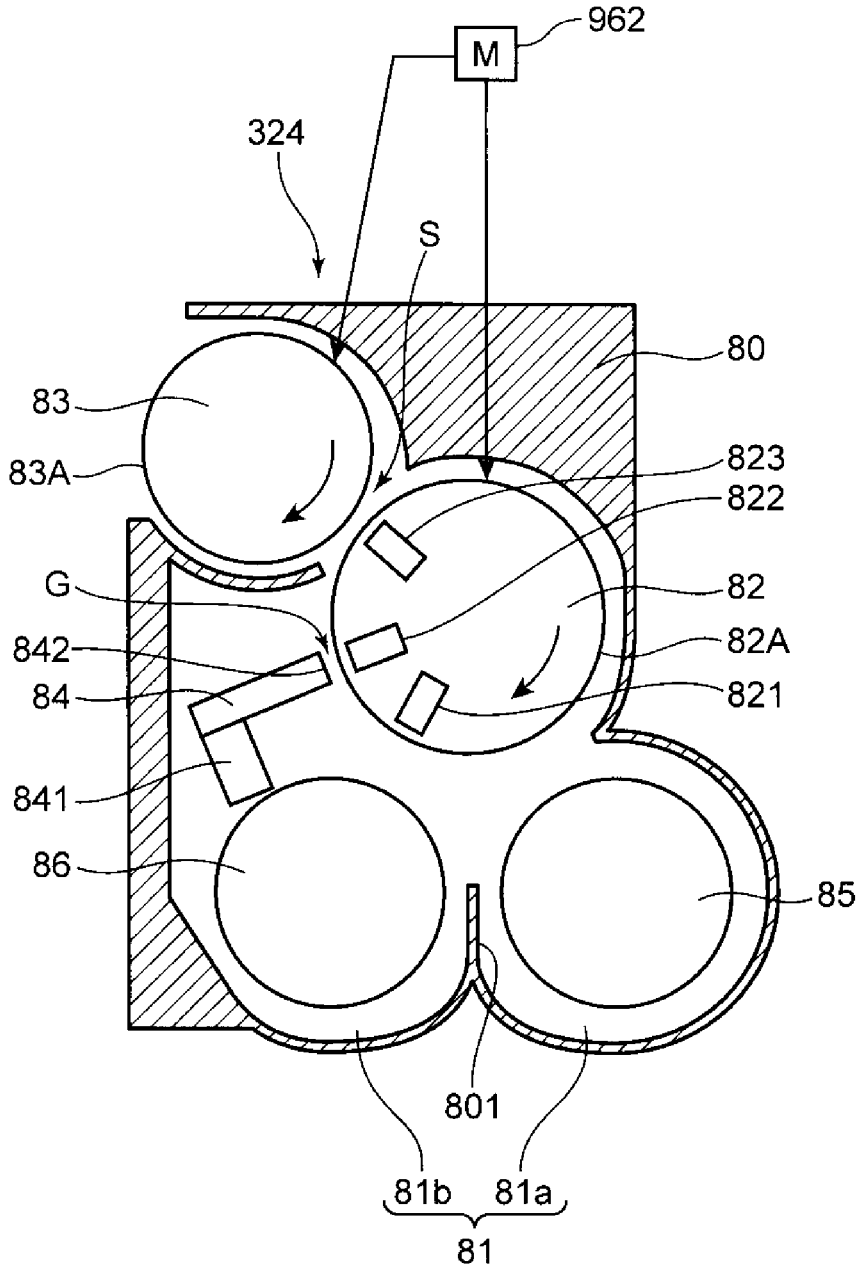
FIG. 2 is a sectional view of a developing device according to the embodiment of the present disclosure.
Figure 3:
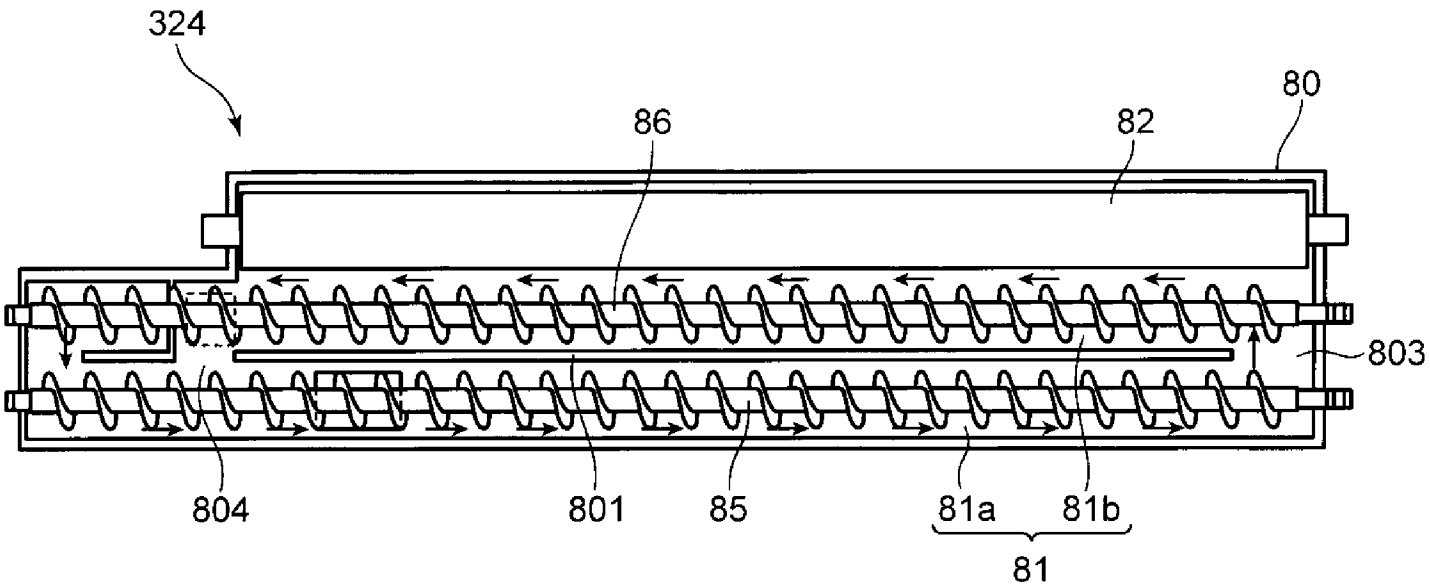
FIG. 3 is a view showing a structure in the developing device according to the embodiment of the present disclosure.

Following the above, a detailed description is given of the developing device 324. FIG. 2 is a sectional view along an up-down direction and a left-right direction schematically showing an internal structure of the developing device 324. FIG. 3 is a sectional view of the developing device 324 along a front-back direction and the left-right direction. The developing device 324 includes a developing housing 80 that defines an internal space of said developing device 324. The developing housing 80 is provided with a developer storing portion 81 for storing a developer containing toner that is a non-magnetic substance and a carrier that is a magnetic substance. Furthermore, inside the developing housing 80, there are provided a magnetic roller 82 (developer bearing member) disposed above the developer storing portion 81, a developing roller 83 (toner bearing member) disposed at a position obliquely above the magnetic roller 82 so as to be opposed to the magnetic roller 82, and a developer restriction blade 84 disposed to be opposed to the magnetic roller 82.

The developer storing portion 81 includes two adjacent developer storing chambers 81*a* and 81*b* that extend in a longitudinal direction of the developing device 324. The developer storing chambers 81*a* and 81*b*, though separated from each other by a partition plate 801 that is formed integrally with the developing housing 80 and extends in the longitudinal direction, communicate with each other at both end portions in the longitudinal direction via communication paths 803 and 804 as shown in FIG. 3. The developer storing chambers 81*a* and 81*b* house screw feeders 85 and 86, respectively, that are configured to rotate about their axes to stir and convey the developer. The screw feeders 85 and 86 are driven to rotate by an unshown drive mechanism in their respective rotation directions set to be reverse to each other. Thus, as shown by arrows in FIG. 3, the developer is conveyed while being stirred to circulate between the developer storing chamber 81*a* and the developer storing chamber 81*b*. By this stirring, the toner and the carrier are mixed with each other, and the toner is charged to, for example, a positive polarity.

The non-magnetic toner used in this embodiment is made of a binder resin, a colorant, and so on. It is appropriate to use, as the binder resin, any of thermoplastic resins such as, for example, polystyrene resin, acrylic resin, styrene-acrylic copolymer, polyethylene resin, polypropylene resin, polyvinyl chloride resin, polyester resin, polyamide resin, polyurethane resin, polyvinyl alcohol resin, vinyl ether resin, N-vinyl resin, and styrene-butadiene resin.

As the colorant, though not particularly limited, for example, black, magenta, cyan, and yellow pigments are usable. These colorants are compounded at a ratio of, typically, 2 to 20 parts by mass and, preferably, 5 to 15 parts by mass with respect to 100 parts by mass of the binding resin.

Any other additive may be added to the toner within such a range as not to impair the effects of this embodiment. As such an additive, for example, a charge control agent and wax are usable. As the charge control agent, any known charge control agent can be used. As a positively chargeable charge control agent, for example, a nigrosine dye, a fatty acid modified nigrosine dye, a carboxyl-containing fatty acid modified nigrosine dye, quaternized ammonium salts, amine compounds, and organometallic compounds can be used.

The wax is not particularly limited, and usable examples thereof include a carnauba wax, a Fisher-Tropsch (hereinafter, may be abbreviated as "FT") wax having ester in its side chain, and synthetic hydrocarbon waxes such as a polyethylene wax and a polypropylene wax. From the viewpoint of dispersibility, it is recommended to use, among these, an FT wax having ester in its side chain or a polyethylene wax.

Furthermore, to the non-magnetic toner, inorganic oxide fine particles are externally added as required. As such an external additive, silica fine particles and fine particles of alumina, titanium oxide, zinc oxide, magnesium oxide, strontium titanate, and so on can be used. Furthermore, an organic external additive such as resin fine particles also can be used as required. It is appropriate that the external additive have a volume mean diameter of 0.001 to 1.0 μm and, preferably, of 0.005 to 0.3 μm. It is preferable that the external additive be added in an amount in a range of 0.1 to 2.0 parts by mass with respect to 100 parts by mass of the toner.

Silica fine particles are used mainly as a fluidizer. Titanium oxide, alumina, resin fine particles, and so on are used as a charging adjustment agent. Furthermore, titanium oxide and so on are favorably used as an abrasive for polishing the surface of a photosensitive member.

The magnetic roller 82 is provided along the longitudinal direction of the developing device 324 and is rotatable in a clockwise direction in FIG. 2. Inside the magnetic roller 82, a stationary so-called magnet roll (not shown) is disposed. The magnet roll has a plurality of magnetic poles and, in this embodiment, has a pumping pole 821, a restricting pole 822, and a main pole 823. The pumping pole 821 is opposed to the developer storing portion 81, the restricting pole 822 is opposed to the developer restriction blade 84, and the main pole 823 is opposed to the developing roller 83.

By using a magnetic force of the pumping pole 821, the magnetic roller 82 magnetically pumps up (receives) the developer from the developer storing portion 81 onto a peripheral surface 82A of the magnetic roller 82. The developer thus pumped up is magnetically held as a developer layer (magnetic brush layer) on the peripheral surface 82A of the magnetic roller 82 and is conveyed toward the developer restriction blade 84 by rotation of the magnetic roller 82.

The developer restriction blade 84 is disposed on an upstream side relative to the developing roller 83 as seen from a rotation direction of the magnetic roller 82 and restricts a layer thickness of the developer layer magnetically adhering to the peripheral surface 82A of the magnetic roller 82. The developer restriction blade 84 is a plate member of a magnetic material extending along a longitudinal direction of the magnetic roller 82 and is supported by a prescribed support member 841 secured at an appropriate location in the developing housing 80. Furthermore, the developer restriction blade 84 has a restriction surface 842 (namely, a tip end surface of the developer restriction blade 84) that forms a restriction gap G having a prescribed dimension between the developer restriction blade 84 and the peripheral surface 82A of the magnetic roller 82.

The developer restriction blade 84 made of the magnetic material is magnetized by the restricting pole 822 of the magnetic roller 82. This causes a magnetic path to be formed between the restriction surface 842 of the developer restriction blade 84 and the restricting pole 822, i.e. in the restriction gap G. When the developer layer made to adhere onto the peripheral surface 82A of the magnetic roller 82 under the action of the pumping pole 821 is conveyed into the restriction gap G by rotation of the magnetic roller 82, the layer thickness of the developer layer is restricted in the restriction gap G. As a result, a uniform developer layer having a prescribed thickness is formed on the peripheral surface 82A.

The developing roller 83 is provided along the longitudinal direction of the developing device 324 so as to extend parallel to the magnetic roller 82 and is rotatable in the clockwise direction in FIG. 2. The developing roller 83 rotates in contact with the developer layer held on the peripheral surface 82A of the magnetic roller 82, and has a peripheral surface 83A that receives toner from the developer layer to bear a toner layer. At the time of development in which the development operation is performed, toner of the toner layer is supplied to a peripheral surface of the photosensitive drum 321.

The developing roller 83 and the magnetic roller 82 are driven to rotate by a drive portion 962 (rotation driver). Between the peripheral surface 83A of the developing roller 83 and the peripheral surface 82A of the magnetic roller 82, there is formed a gap S having a prescribed dimension. The gap S is set to have a dimension of, for example, about 130 μm. The developing roller 83 is disposed to face the photosensitive drum 321 through an opening formed through the developing housing 80, and also between the peripheral surface 83A and the peripheral surface of the photosensitive drum 321, there is formed a gap having a prescribed dimension.

<Electrical Configuration, Block Diagram>

Figure 4:
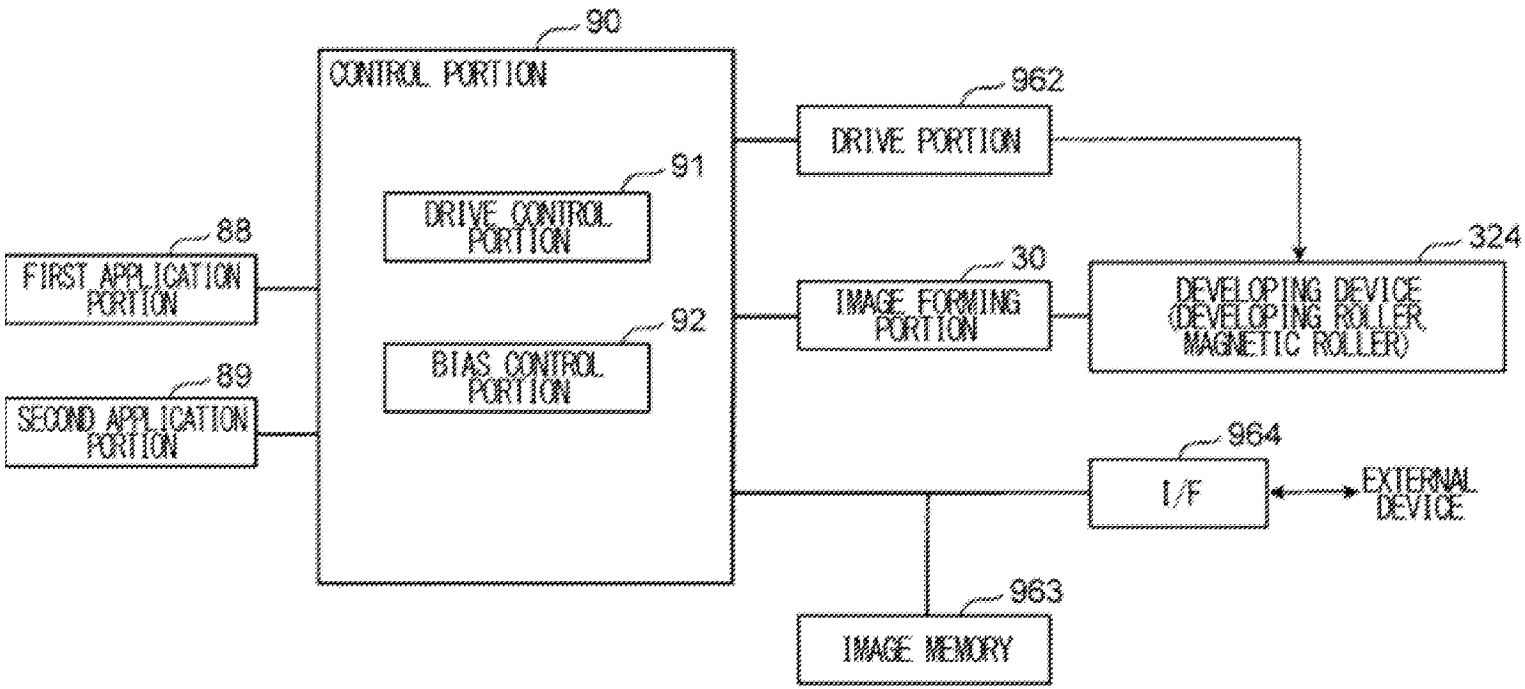
FIG. 4 is a block diagram showing an electrical configuration of the developing device according to the embodiment of the present disclosure.

Following the above, a description is given of a main electrical configuration of the image forming apparatus 1. The image forming apparatus 1 includes a control portion 90 that performs centralized control of operations of the various portions of said image forming apparatus 1. FIG. 4 is a functional block diagram of the control portion 90. The control portion 90 is composed of a CPU (central processing unit), a ROM (read-only memory) that stores a control program, a RAM (random access memory) that is used as a work region for the CPU, and so on. Furthermore, to the control portion 90, in addition to the image forming portion 30 described earlier, a first application portion 88 (bias applier), a second application portion 89 (bias applier), the drive portion 962 (rotation driver), an image memory 963, an I/F 964, and so on are electrically connected.

The first application portion 88 is composed of a direct current power source and an alternating current power source and, based on a control signal from a bias control portion 92 (bias controller), applies a bias to the magnetic roller 82 in the developing device 324. Similarly, the second application portion 89 is composed of a direct current power source and an alternating current power source and, based on a control signal from the bias control portion 92, applies a bias to the developing roller 83 in the developing device 324.

The drive portion 962 is composed of a motor and a gear mechanism that transmits a torque of the motor and, in accordance with a control signal from the control portion 90, drives to rotate the developing roller 83, the magnetic roller 82, the screw feeders 85 and 86, and so on in the developing device 324 at the times of the development operation and the collection operation, which will be described later. In this embodiment, the developing roller 83, the magnetic roller 82, and the screw feeders 85 and 86 are driven to rotate in synchronism with one another by the drive portion 962.

In a case where said image forming apparatus 1 functions as a printer, the image memory 963 temporarily stores image data for printing provided from an external device such as, for example, a personal computer. Furthermore, in a case where the image forming apparatus 1 functions as a copy machine, the image memory 963 temporarily stores image data optically read by the ADF 20.

The I/F 964 is an interface circuit for realizing data communication with an external device. For example, the I/F 964 creates a communication signal conforming to a communication protocol of a network connecting the image forming apparatus 1 to the external device, and converts a communication signal from the network side into data in a format that can be processed by the image forming apparatus 1. A printing command signal transmitted from a personal computer or the like is provided to the control portion 90 via the I/F 964, and image data is stored in the image memory 963 via the I/F 964.

In the control portion 90, the CPU executes a control program stored in the ROM, and thus the control portion 90 functions so as to include a drive control portion 91 and the bias control portion 92 (bias controller).

The drive control portion 91 controls the drive portion 962 so that the drive portion 962 drives to rotate the developing roller 83, the magnetic roller 82, and the screw feeders 85 and 86. Furthermore, the drive control portion 91 controls an unshown driver so that the driver drives to rotate the photosensitive drum 321. In this embodiment, the drive control portion 91 drives to rotate the above-described members in the development operation, the collection operation, and a transition period between these operations.

When the development operation is executed, the bias control portion 92 (bias controller) determines set values of biases to be applied to the developing roller 83 and the magnetic roller 82, and controls the first application portion 88 and the second application portion 89 so that they apply a development bias Bd. Furthermore, when the collection operation is executed, the bias control portion 92 determines set values of biases to be applied to the developing roller 83 and the magnetic roller 82, and controls the first application portion 88 and the second application portion 89 so that they apply a collection bias Br. Moreover, in the transition period from the development operation to the collection operation, the bias control portion 92 determines set values of biases to be applied to the developing roller 83 and the magnetic roller 82 at the time of said transition, and controls the first application portion 88 and the second application portion 89 so that they apply a prescribed bias.

<Regarding Application of Development Bias and Development Operation>

Figure 5:
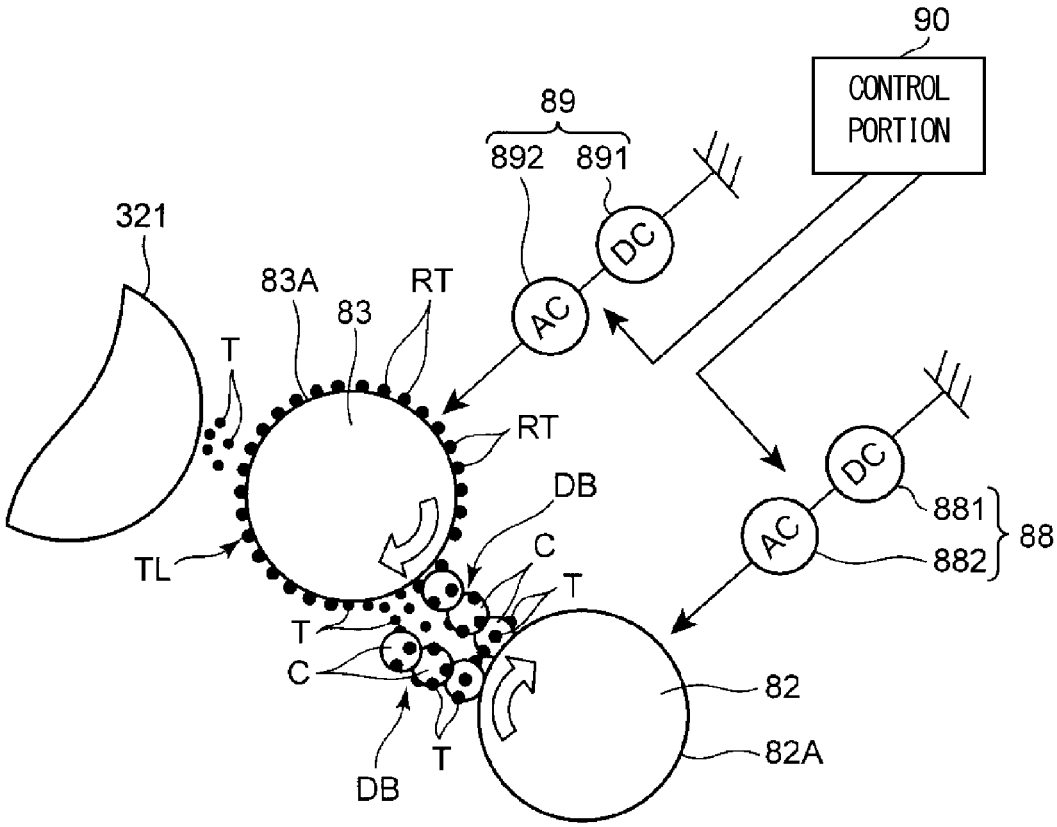
FIG. 5 is a schematic view showing a development operation according to the embodiment of the present disclosure.

Next, with reference to FIG. 5, a description is given of a configuration for bias application and the development operation of the developing device 324. For the purpose of controlling the development operation, the developing device 324 includes the first application portion 88, the second application portion 89, and the control portion 90, which are described earlier. As shown in this figure, the first application portion 88 has a direct current voltage source 881 and an alternating current voltage source 882 that are connected in series to each other, and is connected to the magnetic roller 82. A voltage obtained by superimposing an alternating current bias outputted from the alternating current voltage source 882 on a direct current bias outputted from the direct current voltage source 881 is applied to the magnetic roller 82. The second application portion 89 has a direct current voltage source 891 and an alternating current voltage source 892 that are connected in series to each other, and is connected to the developing roller 83. A voltage obtained by superimposing an alternating current bias outputted from the alternating current voltage source 892 on a direct current bias outputted from the direct current voltage source 891 is applied to the developing roller 83.

Values of a direct current bias and an alternating current bias applied to each of the magnetic roller 82 and the developing roller 83 are changed in accordance with a charging characteristic of toner supplied when the development operation (to develop an electrostatic latent image) is performed in which the developing device 324 supplies the toner onto the peripheral surface of the photosensitive drum 321. Furthermore, after completion of the development operation, in the collection operation for collecting toner adhering to the developing roller 83 onto the magnetic roller 82, biases having still different values are applied to each of the magnetic roller 82 and the developing roller 83.

Next, a description is given of a mechanism for developing an electrostatic latent image on the photosensitive drum 321 in the development operation. A magnetic brush layer on the peripheral surface 82A of the magnetic roller 82, after its layer thickness is restricted to be uniform by the developer restriction blade 84, is conveyed toward the developing roller 83 by rotation of the magnetic roller 82. After that, in a region of the gap S (FIG. 2), a plurality of magnetic brushes DB in the magnetic brush layer come in contact with the peripheral surface 83A of the developing roller 83 in a rotating state.

At this time, the bias control portion 92 controls the first application portion 88 and the second application portion 89 so that a prescribed direct current bias and a prescribed alternating current bias are applied to each of the magnetic roller 82 and the developing roller 83. This causes a prescribed potential difference (potential difference for development) to be generated between the peripheral surface 82A of the magnetic roller 82 and the peripheral surface 83A of the developing roller 83. Due to this potential difference, at a position where the peripheral surface 82A and the peripheral surface 83A are opposed to each other (at a position where the main pole 823 (FIG. 2) and the peripheral surface 83A are opposed to each other), only toner T in the magnetic brushes DB is moved therefrom to the peripheral surface 83A, while carriers C in the magnetic brushes DB and part of toner therein, which is to be residual toner, remain on the peripheral surface 82A. As a result, a toner layer TL having a prescribed thickness is borne on the peripheral surface 83A of the developing roller 83.

The toner layer TL on the peripheral surface 83A is conveyed toward the peripheral surface of the photosensitive drum 321 by rotation of the developing roller 83. A superimposition voltage obtained by superimposing a direct current voltage on an alternating current voltage has been applied to the developing roller 83. This has caused a prescribed potential difference to be generated between the peripheral surface of the photosensitive drum 321 having, on its surface, a potential in accordance with the electrostatic latent image and the peripheral surface 83A of said developing roller 83. Due to this potential difference, the toner T in the toner layer TL is moved to the peripheral surface of the photosensitive drum 321. As a result, the electrostatic latent image on the peripheral surface of the photosensitive drum 321 is developed to form a toner image.

The following is one example of the development bias Bd applied, in the development operation, to the magnetic roller 82 and the developing roller 83 through control of the first application portion 88 and the second application portion 89 by the bias control portion 92.

Direct Current Bias Vmag_dc for Magnetic Roller 82: 450 V

Direct Current Bias Vslv_dc for Developing Roller 83: 150 V

Alternating Current Bias (Vpp) Vmag_ac for Magnetic Roller 82: 800 V (3.6 kHz)

Alternating Current Bias (Vpp) Vslv_ac for Developing Roller 83: 1500 V (3.6 kHz)

Duty Ratio (Duty 1) of Bias between Photosensitive Drum 321 and Developing Roller 83: 37%

Duty Ratio (Duty 2) of Bias between Developing Roller 83 and Magnetic Roller 82: 63%

<Explanation of Collection Operation>

Figure 6A:
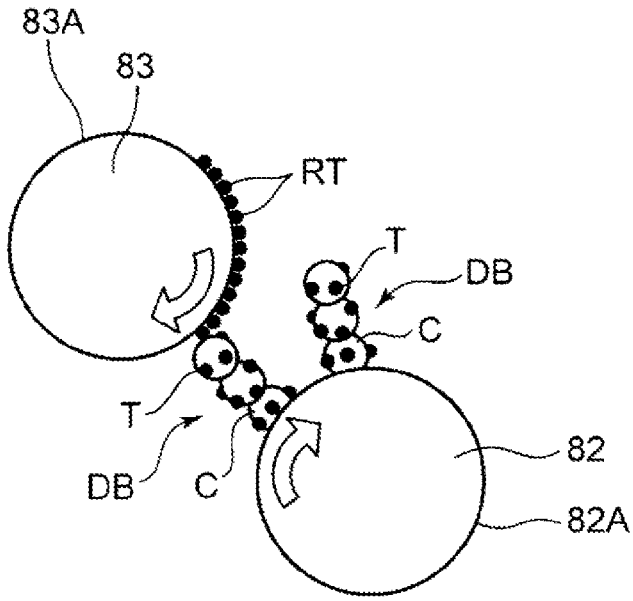
FIG. 6A is a schematic view showing a collection operation according to one embodiment of the present disclosure.
Figure 6B:
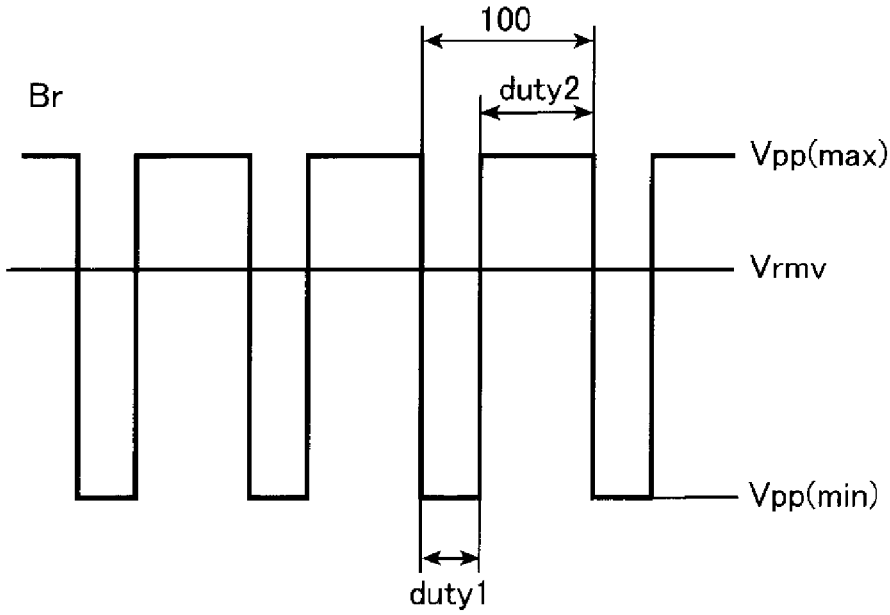
FIG. 6B is an alternating current waveform according to one embodiment of the present disclosure.

Next, a description is given of the collection operation performed in the developing device 324 in this embodiment. FIG. 6(*a*) is a schematic view for explaining the collection operation to collect toner from the developing roller 83 onto the magnetic roller 82. This collection operation is executed at timing at which the earlier described development operation is not executed and that is, for example, before an image formation operation or after the image formation operation.

In an actual development operation, as part of the toner T in the toner layer TL, residual toner RT is generated that is not moved to the photosensitive drum 321 but remains on the peripheral surface 83A. The residual toner RT, when conveyed by rotation of the developing roller 83 to a position where the peripheral surface 83A and the peripheral surface 82A of the magnetic roller 82 are opposed to each other, is collected under a scraping-off force of the magnetic brushes DB and an electric force between both the rollers 82 and 83. The magnetic brushes DB having the residual toner RT thus collected, when conveyed by rotation of the magnetic roller 82 to a downstream side relative to the main pole 823, is collected from the peripheral surface 82A under a magnetic force of a collection pole (not shown) of the magnetic roll and then is fed back to the developer storing portion 81 (FIG. 2) housing the screw feeders 85 and 86.

The following is one example of the collection bias Br that is set by the bias control portion 92 for the purpose of the collection operation. In this embodiment, in each of the development bias Bd and the collection bias Br, a relationship between the alternating current bias Vslv_ac for the developing roller 83 and the alternating current bias Vmag_ac for the magnetic roller 82 is set to 15:8.

Direct Current Bias Vmag_dc for Magnetic Roller 82: 50 V

Direct Current Bias Vslv_dc for Developing Roller 83: 150 V

Alternating Current Bias (Vpp) Vmag_ac for Magnetic Roller 82: 613 V (3.6 kHz)

Alternating Current Bias (Vpp) Vslv_ac for Developing Roller 83: 1150 V (3.6 kHz)

Duty Ratio (Duty 1) of Bias between Photosensitive Drum 321 and Developing Roller 83: 33%

Duty Ratio (Duty 2) of Bias between Developing Roller 83 and Magnetic Roller 82: 67%

The above-described collection bias Br is applied to the developing roller 83 and the magnetic roller 82, and thus as shown in FIG. 6(*b*), a potential difference for collection having an alternating current waveform is set between the peripheral surface 83A of the developing roller 83 and the peripheral surface 82A of the magnetic roller 82. In the figure, duty 1+duty 2 corresponds to one cycle of an alternating current waveform, and in the collection operation, a plurality of cycles of this alternating current waveform are applied per one rotation of the developing roller 83 and the magnetic roller 82. Further, Vrmv denotes a direct current bias potential at the developing roller 83.

As thus described, in this embodiment, in the development operation, the direct current bias for the magnetic roller 82 is set to Vmag_dc: 450 V and the direct current bias for the developing roller 83 is set to Vslv_dc: 150 V, while in the collection operation, the direct current bias for the magnetic roller 82 is set to Vmag_dc: 50V and the direct current bias for the developing roller 83 is set to Vslv_dc: 150V. That is, with respect to the direct current biases, in the development operation, due to a potential difference of 300 V, toner charged to a positive polarity is moved from the magnetic roller 82 toward the developing roller 83. On the other hand, in the collection operation, due to a potential difference of 100 V, the toner is moved from the developing roller 83 toward the magnetic roller 82. At this time, the direct current bias to be applied to the developing roller 83 is maintained to be substantially constant, and thus a potential difference between the developing roller 83 and the photosensitive drum 321 is maintained to be constant, so that the occurrence of leakage between them is prevented.

As described above, before the start of the development operation for image formation or after completion thereof, toner remaining on the developing roller 83 is collected, and thus accumulation of degraded toner and toner having a poor charging characteristic on the developing roller 83 is prevented. Thus, by the developing roller 83, a stable toner image is formed on the photosensitive drum 321. Meanwhile, when, as represented by a case where a circumferential velocity of the photosensitive drum 321 is not less than 100 m/sec, a printing speed of the image forming apparatus 1 is increased, in order for a stable toner image to be formed, preferably, rotation velocities of the developing roller 83 and the magnetic roller 82 are increased. In this case, at a transition stage between the development operation and the collection operation, if biases applied to the magnetic roller 82 and the developing roller 83 abruptly vary, toner might be scattered between the magnetic roller 82 and the developing roller 83, as has conventionally been the case. Particularly at the time of a transition from the development operation to the collection operation, toner is abruptly moved from the developing roller 83 to the magnetic roller 82, so that the above-described toner scattering is likely to occur to a pronounced degree.

<Regarding Duty Control in Transition Period>

Figure 7:
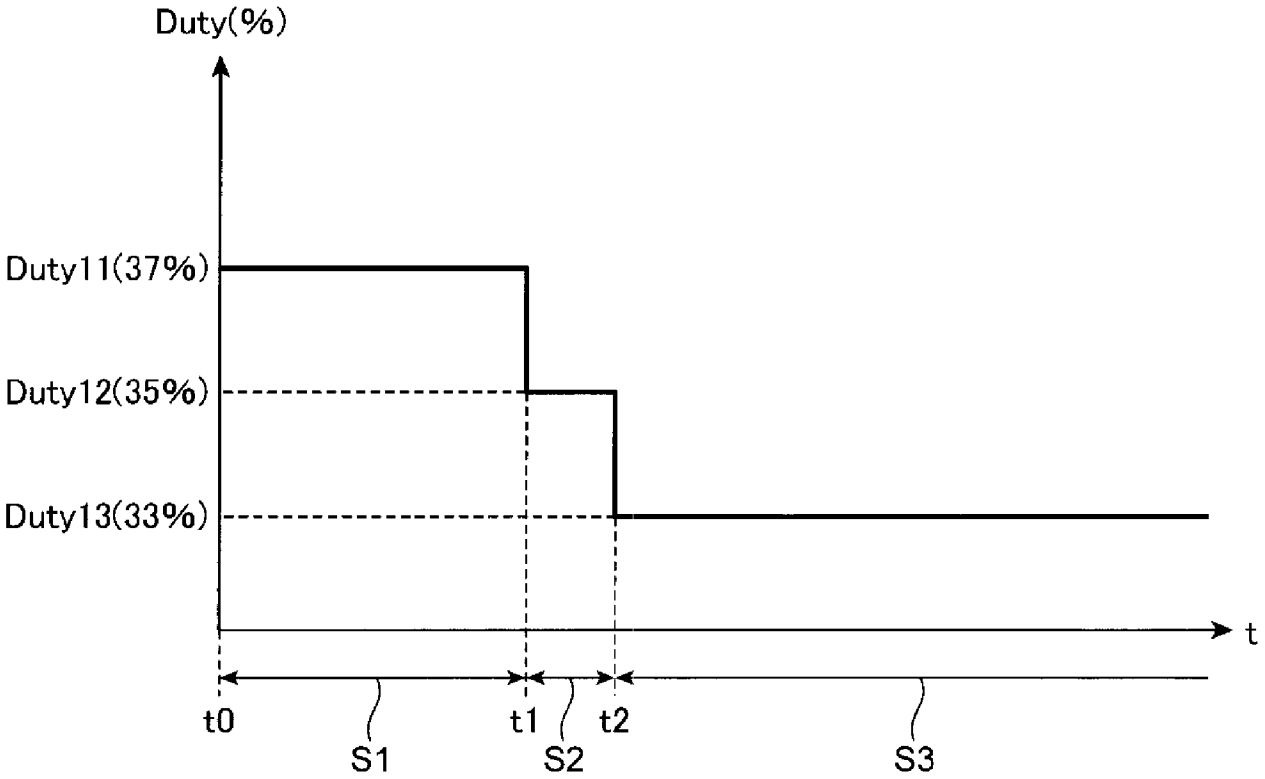
FIG. 7 is a graph showing variations in duty ratio when a transition is made from the development operation to the collection operation in the developing device according to the one embodiment of the present disclosure.

In such a case, however, in this embodiment, at the time of a transition from a development step S1 in which the development operation is executed to a collection step S3 in which the collection operation is executed, a transition period S2 is set. FIG. 7 is a graph showing how a duty ratio of an alternating current bias between the photosensitive drum 321 and the developing roller 83 varies in a case where the transition period S2 is provided after completion of the development step S1 and before the start of the collection step S3. Furthermore, FIG. 8 is a view schematically showing one cycle of each of waveforms of alternating current biases corresponding to duty ratios shown in FIG. 7. FIG. 8 shows waveforms based on alternating current biases at the developing roller 83.

As shown in FIG. 7, in this embodiment, in the development step S1 (from a time t0 to a time t1), a duty ratio (Duty 1) of an alternating current bias between the photosensitive drum 321 and the developing roller 83 is set to a Duty 11, and the development bias Bd is applied. The time t1 corresponds to a printing rear end portion of the final sheet intended to be subjected to image formation. The Duty 11 corresponds to a duty ratio of the development bias Bd and, in this embodiment, is set to 37% as described earlier. Concurrently with completion of the development step S1, the transition period S2 is stared, and by the bias control portion 92, the duty ratio (Duty 1) of an alternating current bias between the photosensitive drum 321 and the developing roller 83 is set to a Duty 12. The Duty 12 is set to be smaller than the Duty 11. In this embodiment, the Duty 12 is set to 35%. Furthermore, in this embodiment, the transition period S2 is set to 8 msec as one example. During this period, a plurality of cycles of alternating current bias is applied between the photosensitive drum 321 and the developing roller 83. Furthermore, during the transition period S2, by the drive portion 962, the photosensitive drum 321 and the various members of the developing device 324 continue to be driven to rotate. Moreover, upon completion of the transition period S2 (time t2), the collection step S3 in which the collection operation is executed is started. The bias control portion 92 sets the duty ratio of an alternating current bias between the photosensitive drum 321 and the developing roller 83 to a Duty 13, and the collection bias Br is applied to the developing roller 83 and the magnetic roller 82. The Duty 13 is set to be smaller than the Duty 12. The Duty 13 corresponds to a duty ratio of the collection bias Br and, in this embodiment, is set to 33% as described earlier.

In other words, the above-described relationships between the duty ratios are as follows: the Duty 12 used in the transition period S2 is set to be smaller than the Duty 11 used in the development operation and larger than the Duty 13 used in the collection operation. In this embodiment, upon the start of the transition period S2, the alternating current biases Vpp and the direct current biases applied to the magnetic roller 82 and the developing roller 83 are changed to the same values as those used in the collection operation after the transition.

Figure 8A:
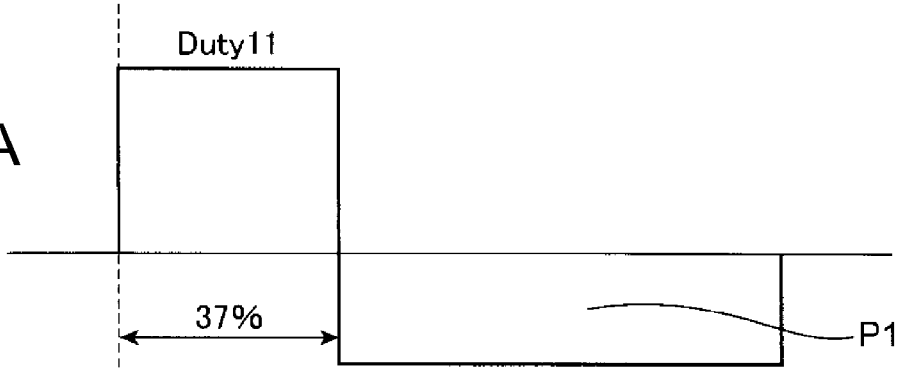
FIGS. 8A-8C are views schematically showing waveforms of alternating current biases based on FIG. 7.
Figure 8B:
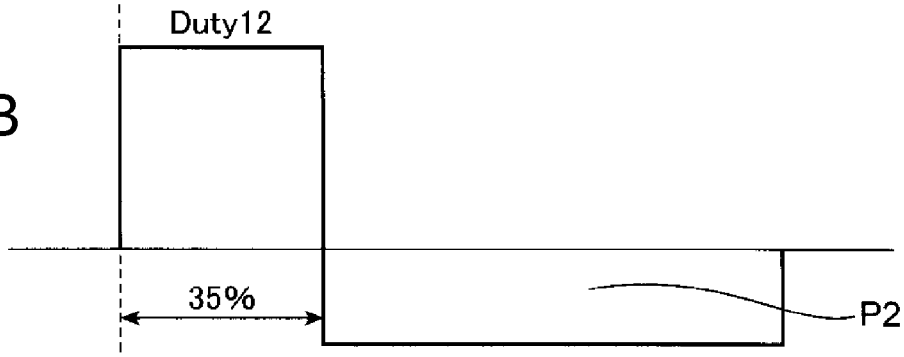
Figure 8C:
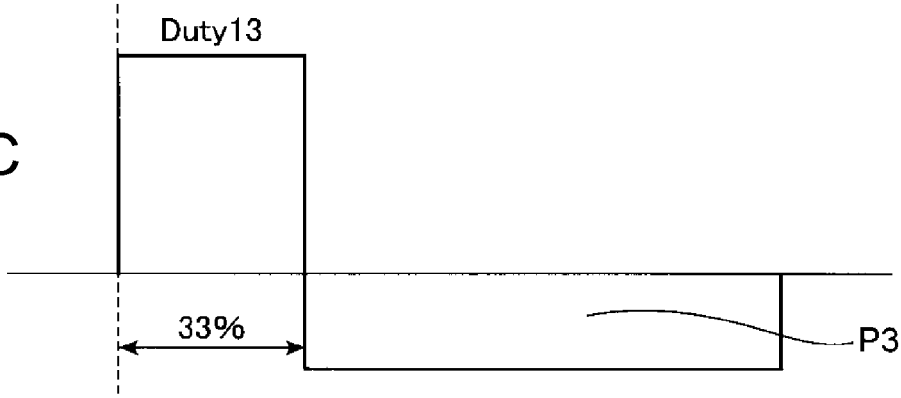

As the transition is made from the development step S1 to the collection step S3 via the transition period S2, the waveform of an alternating current bias applied to the developing roller 83 varies as shown in FIGS. 8(A), 8(B), and 8(C). In this case, waveforms represented respectively by the Duty 11, the Duty 12, and the Duty 13 each exhibit a polarity with which toner is moved from the magnetic roller 82 to the developing roller 83. Accordingly, in waveforms of alternating current biases shown in FIGS. 8(A), 8(B), and 8(C), regions P1 (63%), P2 (65%), and P3 (67%) each form an electric field for toner to be collected from the developing roller 83 toward the magnetic roller 82. That is, an electric field for toner to be collected onto the magnetic roller 82 is formed in stages.

As thus described, in this embodiment, when a transition is made from the development step S1 to the collection step S3, the transition period S2 is set therebetween. With the transition period S2 thus set, a duty ratio of an alternating current bias between the photosensitive drum 321 and the developing roller 83 varies in stages. This favorably prevents a phenomenon in which the duty ratio abruptly varies, so that the residual toner RT (FIG. 7) on the peripheral surface 83A of the developing roller 83 is abruptly moved to the peripheral surface 82A of the magnetic roller 82 and is scattered around.

While the foregoing has discussed the developing device 324 and the image forming apparatus 1 including the same according to the embodiment of the present disclosure, the present disclosure is not limited thereto and can adopt, for example, a modified embodiment below.

(1) While the foregoing embodiment describes a configuration in which, upon the start of the transition period S2, a condition of direct current biases for the magnetic roller 82 and the developing roller 83 is changed to that used in the collection operation after the transition, the present disclosure is not limited thereto. A configuration also may be adopted in which, in the transition period S2, a value of a direct current bias applied to the magnetic roller 82 or the developing roller 83 also varies in stages. In this case, as described earlier, in order to prevent the occurrence of leakage between the developing roller 83 and the photosensitive drum 321, preferably, a direct current bias applied to the developing roller 83 is maintained to be substantially constant. That is, in the development operation, the direct current bias for the magnetic roller 82 is set to Vmag_dc: 450 V and the direct current bias for the developing roller 83 is set to Vslv_dc: 150 V, while in the collection operation, the direct current bias for the magnetic roller 82 is set to Vmag_dc: 50 V and the direct current bias for the developing roller 83 is set to Vslv_dc: 150 V. In this case, in the transition period S2, the direct current bias for the magnetic roller 82 is set to Vmag_dc: 200V, and thus an abrupt movement of toner from the developing roller 83 to the magnetic roller 82 is further suppressed, so that the toner scattering is further prevented.

In other words, in this modified embodiment, a potential difference between the magnetic roller 82 and the developing roller 83 in the development bias Bd is formed by a first direct current bias (Vslv_dc: 150V) that is applied to the developing roller 83 and a second direct current bias (Vmag_dc: 450 V) that is applied to the magnetic roller 82 and has an absolute value larger than that of the first direct current bias. Furthermore, the potential difference between them in the collection bias Br is formed by the first direct current bias (Vslv_dc: 150 V) that is applied to the developing roller 83 and a third direct current bias (Vmag_dc: 50 V) that is applied to the magnetic roller 82 and has an absolute value smaller than that of the first direct current bias. In the transition period S2, when controlling so that alternating current biases are applied at the Duty 12 (third duty ratio), the bias control portion 92 performs control so that the first direct current bias is applied to the developing roller 83 and a fourth direct current bias (Vmag_dc: 200 V) having an absolute value smaller than that of the second direct current bias and larger than that of the third direct current bias is applied to the magnetic roller 82.

Figure 9:
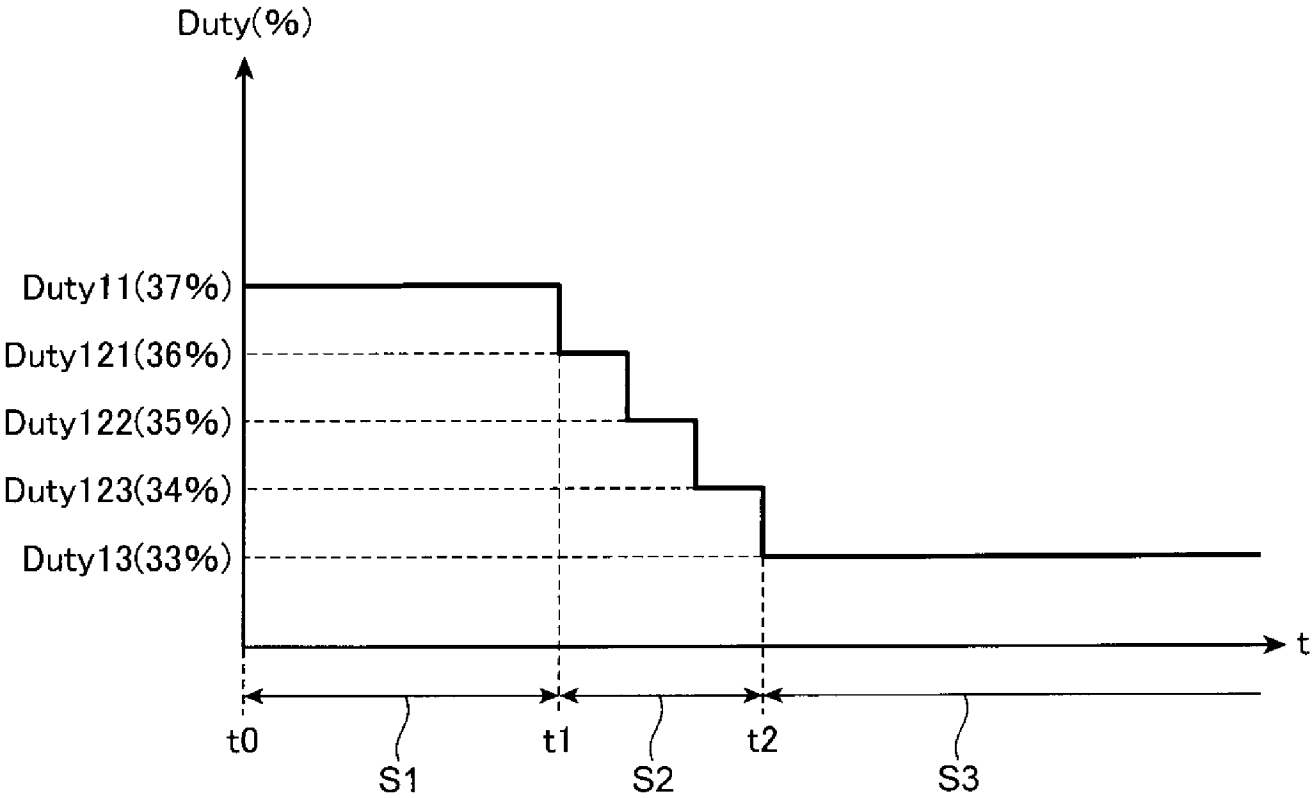
FIG. 9 is a graph showing variations in duty ratio when a transition is made from a development operation to a collection operation in a developing device according to a modified embodiment of the present disclosure.

(2) Furthermore, while the foregoing embodiment describes a configuration in which, in the transition period S2, a condition of one duty ratio (Duty 12) is set, the present disclosure is not limited thereto. A configuration also may be adopted in which, as shown in FIG. 9, in the transition period S2, control is performed so that, between the Duty 11 and the Duty 13, the Duty 12 varies in stages over a plurality of duty ratios (Duty 121, Duty 122, Duty 123).

EXAMPLES

The following describes in further detail the embodiments of the present disclosure by way of Examples and Comparative Examples without limiting the present disclosure to Examples described below. Experimental conditions used in comparative experiments carried out are as follows.

Conditions Common to Examples 1 and 2 and Comparative Example

<Photosensitive Drum 321>
Material: Single Layer OPC
Linear Velocity: 130 mm/sec
<Developing Roller 83>
Diameter: 16 mm
Gap (Distance at Opposed Portion) from Photosensitive Drum 321: 0.12 mm
Revolutions per Minute: 252 rpm (Circumferential Velocity Ratio of 1.5 with respect to Photosensitive Drum 321, With-rotation)
<Magnetic Roller 82>
Diameter: 16 mm
Gap S between Magnetic Roller 82 and Developing Roller 83: 0.30 mm
Revolutions per Minute: 285 rpm (Circumferential Velocity Ratio of 1.1 with respect to Developing Roller 83, Counter-rotation)
<Two-Component Developer>
Number Mean Particle Diameter of Toner: 6.8 nm
Polarity of Toner: Positive Charging Characteristic
Specific Gravity of Toner: 1.2
Number Mean Particle Diameter of Carrier: 35 nm
Specific Gravity of Carrier: 4.5
Charging Amount of Toner at Initial Stage of Test: 15 μC/g
<Conditions for Test Printing>
Printing Rate: 5%
Unit Number of Sheets Printed in Printing Job: Three Sheets by Intermittent Printing
Total Number of Sheets Printed: 5000 sheets
<Condition of Potential of Photosensitive Drum 321>
Image Portion Potential: +60 V
Non-image Portion Potential: +470 V
<Common Conditions Regarding Development Bias>
Direct Current Bias Vmag_dc of Magnetic Roller 82: 450 V
Direct Current Bias Vslv_dc of Developing Roller 83: 150 V
Alternating Current Bias (Vpp) Vmag_ac of Magnetic Roller 82: 800 V (3.6 kHz)
Alternating Current Bias (Vpp) Vslv_ac of Developing Roller 83: 1500 V (3.6 kHz)
Duty ratios are shown in Table 1.
<Common Conditions Regarding Collection Bias>
Direct Current Bias Vmag_dc of Magnetic Roller 82: 50 V
Direct Current Bias Vslv_dc of Developing Roller 83: 150 V
Alternating Current Bias (Vpp) Vmag_ac of Magnetic Roller 82: 613 V (3.6 kHz)
Alternating Current Bias (Vpp) Vslv_ac of Developing Roller 83: 1150 V (3.6 kHz)
Duty ratios are shown in Table 1.

Table 1 shows the duty ratios (Duty 1) set in Examples 1 and 2 and Comparative Example. In Comparative Example, no transition period is provided, and a transition is, therefore, made directly from the development operation to the collection operation. In Example 1, the duty ratio (Duty 1) of an alternating current bias between the photosensitive drum 321 and the developing roller 83 is decreased in stages by 2%. Furthermore, in Example 2, the duty ratio (Duty 1) of an alternating current bias between the photosensitive drum 321 and the developing roller 83 is decreased in stages by 1%.

TABLE 1

| | Ex. 1 | Example 2 | Com. Example |
|---|---|---|---|
| Duty for Development Operation | 37% | 37% | 37% |
| Duty for Collection Operation | 33% | 35% | 33% |
| ΔDuty for Transition Period | 2% | 1% | None |
| Time Limit on Transition Period | 10 msec | 10 msec | None |
| Number of Sheets of Toner Drop Images | 19 | 24 | 76 |

Under the above conditions, printing was executed, and the number of sheets of toner drop images among 5000 sheets of printed images was counted. A toner drop image refers to an image defect caused by a phenomenon in which toner scattered in the vicinity of the magnetic roller 82 and the developing roller 83 is deposited on the developer restriction blade 84 or an inner wall of the developing housing 80, after which it drops as a toner lump on the magnetic roller 82 and automatically adheres to the photosensitive drum 321.

As shown in Table 1, in contrast to Comparative Example, in Examples 1 and 2 in each of which the transition period is provided, the number of printed sheets of toner drop images is reduced. As thus described, at the time of a transition from the development operation to the collection operation, a duty component of an alternating current bias is controlled in stages, and thus toner scattering that occurs when a bias abruptly varies is favorably prevented.

What is claimed is:

1. A developing device, comprising:

a developing housing that stores a developer containing toner and a carrier;

a developer bearing member that, while rotating in a prescribed direction, receives a developer in the developing housing so as to bear a developer layer;

a toner bearing member that, while rotating in contact with the developer layer, receives toner from the developer layer so as to bear a toner layer, and supplies said toner to an image bearing member that bears a toner image into which an electrostatic latent image formed on a surface of the image bearing member is manifested with the toner;

a bias applier that applies a bias obtained by superimposing a direct current bias on an alternating current bias to at least one of the developer bearing member and the toner bearing member so as to form a prescribed potential difference between the developer bearing member and the toner bearing member;

a bias controller that performs control so that at the time of a development operation in which toner is supplied from the developer bearing member to the toner bearing member, the bias applier applies a development bias, and so that at the time of a collection operation in which toner borne by the toner bearing member is forcibly moved back to the developer bearing member, the bias applier applies a collection bias; and a rotation driver that drives to rotate the developer bearing member and the toner bearing member at the time of the development operation and at the time of the collection operation wherein with respect to a duty ratio of the alternating current bias of a polarity with which the toner is moved from the developer bearing member to the toner bearing member, a second duty ratio that is a duty ratio of the collection bias is set to be smaller than a first duty ratio that is a duty ratio of the development bias, and when a transition is made from the development operation to the collection operation, in a state where the developer bearing member and the toner bearing member are being driven to rotate, the bias controller performs control so that the bias applier applies the alternating current bias having a third duty ratio that is smaller than the first duty ratio and larger than the second duty ratio.

2. The developing device according to claim 1, wherein the third duty ratio is controlled so as to be decreased in stages over a plurality of duty ratios.

3. The developing device according to claim 1, wherein with respect to the development bias, a first direct current bias is applied to the toner bearing member, and a second direct current bias having an absolute value larger than that of the first direct current bias is applied to the developer bearing member, and with respect to the collection bias, the first direct current bias is applied to the toner bearing member, and a third direct current bias having an absolute value smaller than that of the first direct current bias is applied to the developer bearing member.

4. The developing device according to claim 2, wherein with respect to the development bias, a first direct current bias is applied to the toner bearing member, and a second direct current bias having an absolute value larger than that of the first direct current bias is applied to the developer bearing member, and with respect to the collection bias, the first direct current bias is applied to the toner bearing member, and a third direct current bias having an absolute value smaller than that of the first direct current bias is applied to the developer bearing member.

5. The developing device according to claim 3, wherein when controlling so that the bias applier applies the alternating current bias having the third duty ratio, the bias controller performs control so that the first direct current bias is applied to the toner bearing member and a fourth direct current bias having an absolute value smaller than that of the second direct current bias and larger than that of the third direct current bias is applied to the developer bearing member.

6. An image forming apparatus comprising the developing device according to claim 1, comprising:

an image bearing member that bears an electrostatic latent image and a toner image that is formed by toner supplied from the toner bearing member.

* * * * *